US005343598A

United States Patent [19]

Hauner

[11] Patent Number: 5,343,598

[45] Date of Patent: Sep. 6, 1994

[54] DEVICE TO PROCESS A PLURALITY OF FIBER SLIVERS

[75] Inventor: Friedrich Hauner, Ingolstadt, Fed. Rep. of Germany

[73] Assignee: Rieter Ingolstadt, Ingolstadt, Fed. Rep. of Germany

[21] Appl. No.: 983,479

[22] Filed: Dec. 2, 1992

[30] Foreign Application Priority Data

Dec. 19, 1991 [DE] Fed. Rep. of Germany ..... 4142038

[51] Int. Cl.[5] ..... D01H 5/72

[52] U.S. Cl. ..... 19/292; 19/150

[58] Field of Search ..... 19/236, 243, 288, 291, 19/292, 150, 157, 144, 145.5, 106 R, 0.23

[56] References Cited

U.S. PATENT DOCUMENTS

| | | | |
|---|---|---|---|
| 2,661,503 | 12/1953 | Longstreet | 19/157 |
| 3,216,064 | 11/1965 | Kates, Jr. | 19/145.5 |
| 3,447,206 | 6/1969 | Klein et al. | 19/150 |
| 4,195,388 | 4/1980 | Bulla | 19/157 |
| 4,884,320 | 12/1989 | Gasser et al. | 19/106 R |
| 4,949,431 | 8/1990 | Gasser | 19/150 |
| 4,996,748 | 3/1991 | Jornot | 19/157 |
| 5,018,246 | 5/1991 | Leifeld | 19/150 |
| 5,023,976 | 6/1991 | Meyer et al. | 19/144 |
| 5,095,587 | 3/1992 | Kluttermann et al. | 19/150 |
| 5,123,280 | 6/1992 | Baechler | 19/150 |
| 5,161,284 | 11/1992 | Leifeld | 19/243 |

*Primary Examiner*—Clifford D. Crowder
*Assistant Examiner*—Michael A. Neas
*Attorney, Agent, or Firm*—Dority & Manning

[57] ABSTRACT

The invention relates to a device for the processing of a plurality of fiber slivers, in particular a drawing frame with drawing-in cylinders for joint feeding of the fiber slivers to the device. A funnel with a passage opening is provided in the device to unite the fiber slivers into a fiber sliver amalgam as the fiber slivers go through the funnel (1). The cross-sectional area of the passage opening of the funnel is adjustable.

5 Claims, 2 Drawing Sheets

DEVICE TO PROCESS A PLURALITY OF FIBER SLIVERS

The instant invention relates to a device, in particular to a drawing frame, for the processing of a plurality of fiber slivers with drawing-in cylinders for a combined feed of the fiber slivers to the device and with a funnel with a passage opening to unite the fiber slivers as they go through the funnel.

Bringing together several fiber slivers fed in parallel in a funnel to measure the thickness of the totality of the fiber slivers in a scanning device following the funnel is known from a controlled drawing frame of Schubert & Salzer. The fiber slivers are compressed in the funnel and are fed in this condition to the scanning device. The disadvantage of this funnel is that different funnels must be used depending on the number of the fiber sliver fed or of the thickness of the fiber slivers so that they may go through the outlet of the funnel without clogging it. Such a funnel is not provided on a drawing frame without control. When reserve slivers are fed the disadvantage is that the reserve sliver newly added to the other fiber slivers blends insufficiently with the other fiber slivers so that they are not properly fed to the device.

DE 27 13 355 furthermore discloses a method by which a reserve sliver is fed to the remaining fiber slivers where a fiber sliver breaks or runs out. Depending on the location at which a fiber sliver is missing, the reserve sliver is conveyed to the remaining fiber slivers at that location. Following the reserve sliver feed device the fiber slivers goes through a combining roller which provokes homogenization of the amalgam of fiber slivers through pressure on said fiber slivers. In this device it is a disadvantage that the reserve sliver must be fed to the location of the missing fiber sliver and can only then be fed to the amalgam of fiber slivers in order to unite all fiber slivers, including the reserve sliver. Sufficient precision in the homogenization and even blending of the fiber amalgam over its entire width and height is not possible with this device unless the reserve sliver feed device is positioned exactly.

It is therefore the object of the instant invention to create a device by means of which the fed fiber slivers are united in such manner that cohesion of the fiber slivers is achieved and in which the start of a reserve fiber sliver can also be included. This object is attained through the invention in that the cross-sectional area of the passage opening of the funnel is adjustable. Thanks to the adjustable passage opening it is possible to adjust the funnel so that it can be used universally for different numbers of fiber slivers to be processed or for fiber slivers of different thickness. The funnel is adjustable so that uniform density of the fiber amalgam after the funnel can be achieved, whatever the number of fiber slivers processed.

The force of compression of the fiber slivers in the funnel can be selected in function of the fiber material.

By making the lateral surfaces of the funnel so that they can be adjusted perpendicularly to the direction of fiber sliver movement, the conveyed fiber slivers can be brought together into a homogenous fiber amalgam. With fibers clinging together in reaction to even minimal pressure a wider position of the lateral surfaces is possible than with fibers which cling together only when greater pressure is exerted on them, producing greater density of the fiber amalgam.

An additional input slope provided at the input opening of the funnel ensures that a fiber sliver fed from above is introduced into the funnel without being eliminated even before passing through the funnel and can thus be integrated into the amalgam together with the other fiber slivers.

If the funnel is installed directly after the feed device for reserve fiber slivers, this advantageously ensures that the reserve fiber sliver is integrated into the existing fiber amalgam as it goes through the funnel and that it is thus not eliminated from the fiber amalgam as the it is introduced into the processing unit, e.g. into the drawing frame, but is processed without time delay.

The embodiment of the invention is explained below through FIGS. 1 and 2.

Figure 1:
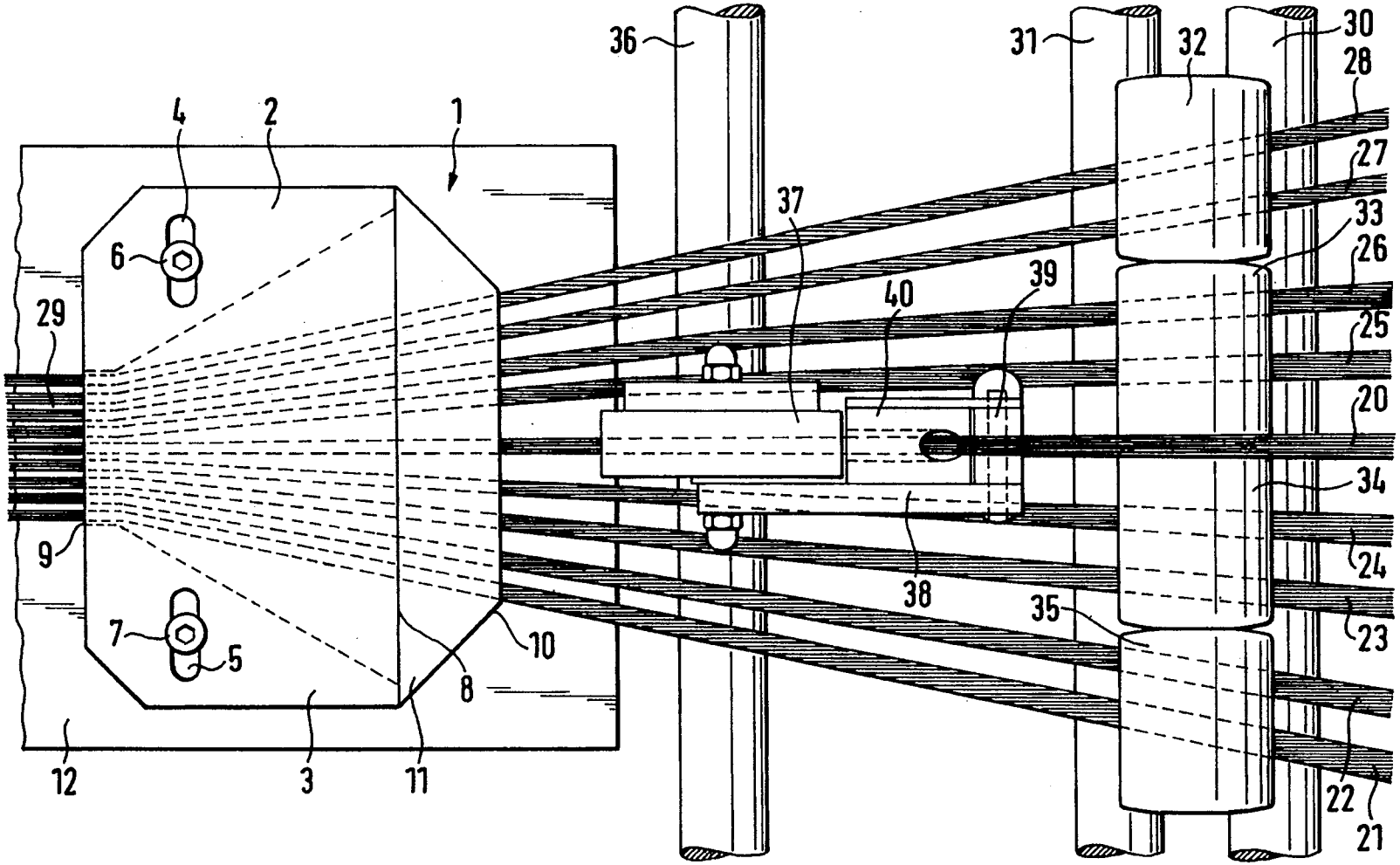
FIG. 1 shows a top view of a device according to the invention.

FIG. 1 shows a top view of the device according to the invention. A funnel 1 is installed on a processing unit 12. The funnel 1 consists of lateral elements 2 and 3 and of a cover 11. The underside of the funnel 1 is formed by the processing unit 12. The positions of the lateral elements 2 and 3 determine the cross sectional areas available for a reserve sliver 20 or to fiber slivers 21 to 38 in an input opening 8 and in an output opening 9. The fiber slivers 20 to 28 coming out of the funnel constitute a fiber amalgam 29 after the funnel 1. The position of the lateral elements 2 and 3 can be changed by means of oblong holes 4 and 5 and screws 6 and 7. The lateral elements 2 and 3 can be displaced along the oblong holes 4 and 5 in function of the thickness of fiber slivers 20 to 28 or of the desired compression of the fiber slivers 20 to 28 in order to obtain a pre-defined fiber amalgam 29. An advantageous continuous adjustment of the areas of the cross-section of the funnel 1 is thus ensured.

The fiber sliver 29 can be conveyed either into a control device (not shown) or directly into the processing unit, e.g. a drawing frame.

If one of the fiber slivers 21 to 28 is missing, a contact roller 32 to 35 closes a contact between a drawing-in cylinder 30 and a drawing-in cylinder 31. This contact causes a drawing-in cylinder 36 to be set in motion after an appropriate time delay so that the reserve sliver 20 which is held between the drawing-in cylinder 36 and a roller 37 to be introduced into the funnel 1 and to be thus added to the fiber amalgam 29. The reserve fiber sliver 20 is integrated into the fiber amalgam 29 in the manner of one of the fiber slivers 21 to 28 as a result of compression. As soon as the previously run-out sliver 21 to 28 is made ready again by an operator, the drawing-in cylinder 36 is stopped again as a result of the interruption of the contact between the drawing-in cylinders 30 and 31 by the contact roller 32 to 35 so that the reserve sliver 20 located between the drawing-in cylinder 36 and roller 37 tears off and is replaced by the newly added fiber sliver 21 to 28.

Figure 2:
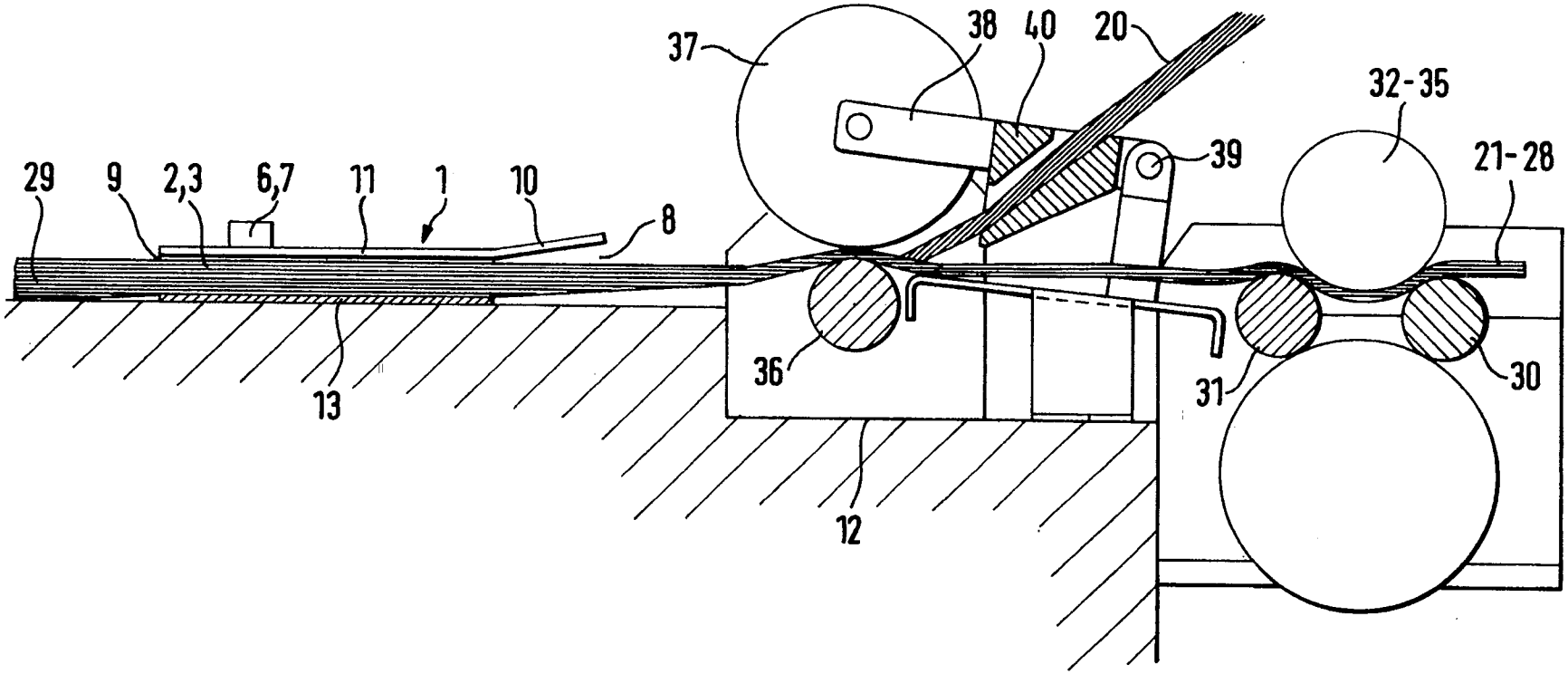
FIG. 2 shows a side view of this device.

FIG. 2 shows a side view of the device according to the invention. The fiber slivers 21 to 28 are guided between the drawing-in rollers 30, 31 and the contact rollers 32 to 35. The reserve fiber sliver is guided by a reserve sliver guide 40 which is mounted on a holder 38 mounted on a rotating shaft 39 together with roller 37. Roller 37 holds the reserve sliver 20 with its own weight on the drawing-in cylinder 36. Whenever necessary the drawing-in cylinder 36 is rotated and conveys the reserve fiber sliver 20 into the funnel 1.

The sliver 29 is formed by lateral elements 2, 3 and the cover 11 attached on these lateral elements 2, 3 by means of a screw 6, 7.

An input slope 10 is provided on the cover 11 at the input opening 8. The input slope 10 causes the reserve sliver to be introduced safely into the funnel 1. This prevents the reserve fiber sliver 20 from lying on top of the fiber slivers 21 to 28 and instead of being introduced into the funnel 1 to be eliminated even before this. The input slope 10 reliably guides the reserve fiber sliver 20 into the funnel 1, even if it is lying on top of the fiber slivers 21 to 28.

A change of the cross-sectional area can be effected on the one hand through lateral displacement of the lateral elements 2, 3 and on the other hand by controlling the height of funnel 1. A height variation of the cross-sectional area of the passage can be effected by enlarging the passage height of the funnel 1 by means of a spacer 13. The spacer 13 can be inserted below the lateral elements 2, 3 as shown, or between the lateral elements 2, 3 and cover 11.

The invention also provides the advantage that an adjustment of the funnel 1 results in a lateral correction of the fiber sliver amalgam 29 when the distance from a central line of the conveyed fiber slivers 20–28 has.

In this way the fiber sliver feed can be effected individually. The invention also covers a funnel in which the area of the input cross-section always remains the same but where the area of the output cross-section is however adjustable.

I claim:

1. A device for processing a plurality of fiber slivers, said device utilizing drawing-in cylinders for joint feed of fiber slivers into said device, said device comprising a funnel for uniting the fiber slivers into a fiber amalgam as the fiber slivers pass therethrough, said funnel including horizontal surfaces and lateral surfaces defining a passage opening into said funnel, said lateral surfaces being adjustable relative to said horizontal surfaces so that the total effective cross-sectional area of said passage opening presented to the fiber slivers is adjustable depending on the degree of compression of the fiber slivers desired, said device further comprising lateral elements defining said lateral surfaces, said funnel comprising a cover supported above said adjustable lateral elements, said lateral surfaces being adjustable below and relative to said cover so that said passage opening is defined by said cover and said lateral surfaces, the degree of movement of said lateral surfaces relative said cover being defined by oblong holes defined in said lateral elements, said oblong holes engaged by attaching devices for attaching said lateral elements to said cover.

2. The device as in claim 1, wherein said attaching devices comprises screws.

3. A device for processing a plurality of fiber slivers, said device utilizing drawing-in cylinders for joint feed of fiber slivers into said device, said device comprising a funnel for uniting the fiber slivers into a fiber amalgam as the fiber slivers pass therethrough, said funnel including horizontal surfaces and lateral surfaces defining a passage opening into said funnel, said lateral surfaces being adjustable relative to said horizontal surfaces so that the total effective cross-sectional area of said passage opening presented to the fiber slivers is adjustable depending on the degree of compression of the fiber slivers desired, said device further comprising lateral elements defining said lateral surfaces, said funnel comprising a cover supported above said adjustable lateral elements, said lateral surfaces being adjustable below and relative to said cover so that said passage opening is defined by said cover and said lateral surfaces, the degree of movement of said lateral surfaces relative said cover being defined by oblong holes defined in said cover, said oblong holes engaged by attaching devices for attaching said lateral elements to said cover.

4. A funnel for use with a sliver fiber processing machine, said funnel for condensing a plurality of fiber slivers into a fiber amalgam as the fiber slivers pass therethrough, said funnel comprising horizontal surfaces and adjustable lateral surfaces defining a passage opening into said funnel, said adjustable lateral surfaces adjustably configured so that the total effective cross-sectional area of said passage opening presented to the fiber slivers is adjustable depending on the degree of compression of the fiber slivers desired, said funnel further comprising adjustable lateral elements, said lateral elements defining said lateral surfaces, said funnel comprising a cover supported above said adjustable lateral elements, said lateral surfaces being adjustable below and relative to said cover so that said passage opening is defined by said cover and said lateral surfaces, the degree of movement of said lateral surfaces relative said cover being defined by oblong holes defined in said lateral elements, said oblong holes engaged by attaching devices for attaching said lateral elements to said cover.

5. A funnel for use with a sliver fiber processing machine, said funnel for condensing a plurality of fiber slivers into a fiber amalgam as the fiber slivers pass therethrough, said funnel comprising horizontal surfaces and adjustable lateral surfaces defining a passage opening into said funnel, said adjustable lateral surfaces adjustably configured so that the total effective cross-sectional area of said passage opening presented to the fiber slivers is adjustable depending on the degree of compression of the fiber slivers desired, said funnel further comprising adjustable lateral elements, said lateral elements defining said lateral surfaces, said funnel comprising a cover supported above said adjustable lateral elements, said lateral surfaces being adjustable below and relative to said cover so that said passage opening is defined by said cover and said lateral surfaces, the degree of movement of said lateral surfaces relative said cover being defined by oblong holes defined in said lateral elements, said oblong holes engaged by attaching devices for attaching said lateral elements to said cover.

* * * * *